US011401571B2

(12) United States Patent
Yokoi et al.

(10) Patent No.: US 11,401,571 B2
(45) Date of Patent: Aug. 2, 2022

(54) HOT-ROLLED STEEL SHEET

(71) Applicant: NIPPON STEEL & SUMITOMO METAL CORPORATION, Tokyo (JP)

(72) Inventors: Tatsuo Yokoi, Tokyo (JP); Mitsuru Yoshida, Tokyo (JP); Natsuko Sugiura, Tokyo (JP); Hiroshi Shuto, Tokyo (JP); Masayuki Wakita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 212 days.

(21) Appl. No.: 15/538,404

(22) PCT Filed: Feb. 20, 2015

(86) PCT No.: PCT/JP2015/054846
§ 371 (c)(1),
(2) Date: Jun. 21, 2017

(87) PCT Pub. No.: WO2016/132542
PCT Pub. Date: Aug. 25, 2016

(65) Prior Publication Data

US 2017/0349967 A1 Dec. 7, 2017

(51) Int. Cl.
*C22C 38/58* (2006.01)
*C22C 38/02* (2006.01)
(Continued)

(52) U.S. Cl.
CPC ..... *C21D 9/46* (2013.01); *B21B 3/02* (2013.01); *C21D 6/001* (2013.01); *C21D 6/002* (2013.01);
(Continued)

(58) Field of Classification Search
CPC ..... C21D 9/46; C21D 6/001; C21D 6/002; C21D 6/005; C21D 6/007; C21D 6/008;
(Continued)

(56) References Cited

U.S. PATENT DOCUMENTS 4,501,626 A 2/1985 Sudo et al.
6,251,198 B1 6/2001 Koo et al.
(Continued)

FOREIGN PATENT DOCUMENTS

CA 2882333 A1 4/2014
CA 2944863 A1 10/2015
(Continued)

OTHER PUBLICATIONS

Machine translation of WO-2014014120-A1 (Year: 2014).*
(Continued)

*Primary Examiner* — Anthony J Zimmer
*Assistant Examiner* — Sean P. O'Keefe
(74) *Attorney, Agent, or Firm* — Birch, Stewart, Kolasch & Birch, LLP

(57) ABSTRACT

A hot-rolled steel sheet includes a specific chemical composition, and includes a microstructure represented by, in vol %: retained austenite: 2% to 30%; ferrite: 20% to 85%; bainite: 10% to 60%; pearlite: 5% or less; and martensite: 10% or less. A proportion of grains having an intragranular misorientation of 5° to 14° in all grains is 5% to 50% by area ratio, the grain being defined as an area which is surrounded by a boundary having a misorientation of 15° or more and has a circle-equivalent diameter of 0.3 μm or more.

4 Claims, 3 Drawing Sheets

(51) Int. Cl.

| | |
|---|---|
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C21D 9/46*** | (2006.01) |
| ***C22C 38/00*** | (2006.01) |
| ***B21B 3/02*** | (2006.01) |
| ***C21D 6/00*** | (2006.01) |
| ***C21D 8/02*** | (2006.01) |

(52) U.S. Cl.

CPC ..... *C21D 6/005* (2013.01); *C21D 6/007* (2013.01); *C21D 6/008* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/18* (2013.01); *C22C 38/58* (2013.01); *B21B 2261/20* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC .. C21D 8/0205; C21D 8/0226; C21D 8/0263; C21D 2211/001; C21D 2211/002; C21D 2211/005; C21D 2211/008; C22C 38/001; C22C 38/002; C22C 38/005; C22C 38/02; C22C 38/04; C22C 38/06; C22C 38/00; C22C 38/08; C22C 38/10; C22C 38/12; C22C 38/14; C22C 38/16; C22C 38/58; B21B 3/02

See application file for complete search history.

(56) References Cited

U.S. PATENT DOCUMENTS

| | | | | |
|---|---|---|---|---|
| 6,254,698 | B1 | 7/2001 | Koo et al. | |
| 6,589,369 | B2 * | 7/2003 | Yokoi | C21D 8/0226 148/320 |
| 7,662,243 | B2 * | 2/2010 | Yokoi | C21D 8/0226 148/320 |
| 7,749,338 | B2 * | 7/2010 | Yokoi | C22C 38/001 148/320 |
| 8,353,992 | B2 * | 1/2013 | Sugiura | C21D 6/005 148/320 |
| 10,889,879 | B2 | 1/2021 | Sano et al. | |
| 2002/0036035 | A1 | 3/2002 | Kashima et al. | |
| 2003/0063996 | A1 | 4/2003 | Funakawa et al. | |
| 2003/0084973 | A1 * | 5/2003 | Issartel | C22C 38/002 148/654 |
| 2004/0074573 | A1 | 4/2004 | Funakawa et al. | |
| 2005/0150580 | A1 | 7/2005 | Akamizu et al. | |
| 2006/0081312 | A1 | 4/2006 | Yokoi et al. | |
| 2006/0266445 | A1 | 11/2006 | Yokoi et al. | |
| 2009/0050243 | A1 | 2/2009 | Satou et al. | |
| 2009/0050244 | A1 | 2/2009 | Nakagawa et al. | |
| 2009/0092514 | A1 | 4/2009 | Asahi et al. | |
| 2009/0214377 | A1 * | 8/2009 | Hennig | C21D 1/20 420/120 |
| 2010/0047617 | A1 * | 2/2010 | Sugiura | C21D 6/005 428/659 |
| 2010/0108200 | A1 | 5/2010 | Futamura et al. | |
| 2010/0108201 | A1 | 5/2010 | Yokoi et al. | |
| 2010/0319819 | A1 | 12/2010 | Kaneko et al. | |
| 2011/0017360 | A1 * | 1/2011 | Yoshinaga | C21D 8/0426 148/516 |
| 2011/0024004 | A1 | 2/2011 | Azuma et al. | |
| 2011/0297281 | A1 | 12/2011 | Satou et al. | |
| 2012/0012231 | A1 | 1/2012 | Murakami et al. | |
| 2012/0018028 | A1 | 1/2012 | Shimamura et al. | |
| 2012/0031528 | A1 | 2/2012 | Hayashi et al. | |
| 2013/0000791 | A1 | 1/2013 | Takahashi et al. | |
| 2013/0087254 | A1 | 4/2013 | Funakawa et al. | |
| 2013/0276940 | A1 | 10/2013 | Nakajima et al. | |
| 2013/0284321 | A1 * | 10/2013 | Bocharova | C22C 38/02 148/547 |
| 2013/0319582 | A1 * | 12/2013 | Yokoi | C21D 8/02 148/602 |
| 2014/0000765 | A1 | 1/2014 | Nozaki et al. | |
| 2014/0014236 | A1 | 1/2014 | Nozaki et al. | |
| 2014/0014237 | A1 | 1/2014 | Yokoi et al. | |
| 2014/0027022 | A1 * | 1/2014 | Yokoi | C22C 38/28 148/504 |
| 2014/0087208 | A1 | 3/2014 | Toda et al. | |
| 2014/0110022 | A1 | 4/2014 | Sano et al. | |
| 2014/0193665 | A1 * | 7/2014 | Kawata | C21D 8/0484 428/633 |
| 2014/0255724 | A1 | 9/2014 | Yamanaka et al. | |
| 2014/0287263 | A1 | 9/2014 | Kawata et al. | |
| 2014/0290807 | A1 | 10/2014 | Goto et al. | |
| 2015/0004433 | A1 | 1/2015 | Tanaka et al. | |
| 2015/0030879 | A1 | 1/2015 | Kosaka et al. | |
| 2015/0071812 | A1 | 3/2015 | Kawano et al. | |
| 2015/0101717 | A1 | 4/2015 | Kosaka et al. | |
| 2015/0191807 | A1 | 7/2015 | Hanlon et al. | |
| 2015/0203949 | A1 | 7/2015 | Yokoi et al. | |
| 2015/0218708 | A1 | 8/2015 | Maruyama et al. | |
| 2015/0322552 | A1 * | 11/2015 | Takashima | C22C 38/06 148/603 |
| 2016/0017465 | A1 | 1/2016 | Toda et al. | |
| 2017/0349967 | A1 | 12/2017 | Yokoi et al. | |
| 2018/0023162 | A1 * | 1/2018 | Sugiura | C21D 9/46 420/83 |
| 2018/0037967 | A1 * | 2/2018 | Sugiura | C21D 9/46 |
| 2018/0037980 | A1 | 2/2018 | Wakita et al. | |
| 2018/0044749 | A1 | 2/2018 | Shuto et al. | |
| 2019/0226061 | A1 | 7/2019 | Sano et al. | |
| 2019/0233926 | A1 * | 8/2019 | Sano | C22C 38/00 |
| 2019/0241996 | A1 | 8/2019 | Sano et al. | |
| 2019/0309398 | A1 * | 10/2019 | Sano | C22C 38/58 |

FOREIGN PATENT DOCUMENTS

| | | | | |
|---|---|---|---|---|
| CN | 1450191 | A | 10/2003 | |
| CN | 101443467 | A | 5/2009 | |
| CN | 101646794 | A | 2/2010 | |
| CN | 101724776 | A | 6/2010 | |
| CN | 101999007 | A | 3/2011 | |
| CN | 103459647 | A | 12/2013 | |
| CN | 103459648 | A | 12/2013 | |
| CN | 104011234 | A | 8/2014 | |
| CN | 107250411 | A | 10/2017 | |
| EP | 1149925 | A1 | 10/2001 | |
| EP | 1 350 859 | A1 | 10/2003 | |
| EP | 1350859 | A1 * | 10/2003 | C21D 8/0226 |
| EP | 1559797 | A1 | 8/2005 | |
| EP | 2 088 218 | A1 | 8/2009 | |
| EP | 2182080 | A1 | 5/2010 | |
| EP | 2453032 | A1 | 5/2012 | |
| EP | 2 530 180 | A1 | 12/2012 | |
| EP | 2599887 | A1 | 6/2013 | |
| EP | 2631314 | A1 | 8/2013 | |
| EP | 2865778 | A1 | 4/2015 | |
| JP | 57-70257 | A | 4/1982 | |
| JP | 58-42726 | A | 3/1983 | |
| JP | 61-217529 | A | 9/1986 | |
| JP | 2-149646 | A | 6/1990 | |

(56) References Cited

FOREIGN PATENT DOCUMENTS

| | | | | |
|---|---|---|---|---|
| JP | 3-180445 | A | 8/1991 | |
| JP | 4-337026 | A | 11/1992 | |
| JP | 5-59429 | A | 3/1993 | |
| JP | 5-163590 | A | 6/1993 | |
| JP | 7-90478 | A | 4/1995 | |
| JP | 9-49026 | A | 2/1997 | |
| JP | 10-195591 | A | 7/1998 | |
| JP | 2001-200331 | A | 7/2001 | |
| JP | 2001-220648 | A | 8/2001 | |
| JP | 2001-303186 | A | 10/2001 | |
| JP | 2002-105595 | A | 4/2002 | |
| JP | 2002-161340 | A | 6/2002 | |
| JP | 2002-226943 | A | 8/2002 | |
| JP | 2002-317246 | A | 10/2002 | |
| JP | 2002-534601 | A | 10/2002 | |
| JP | 2002-322540 | A | 11/2002 | |
| JP | 2002-322541 | A | 11/2002 | |
| JP | 2003-342684 | A | 12/2003 | |
| JP | 2004-218077 | A | 8/2004 | |
| JP | 2004-250749 | A | 9/2004 | |
| JP | 2004-315857 | A | 11/2004 | |
| JP | 2005-82841 | A | 3/2005 | |
| JP | 2005-213566 | A | 8/2005 | |
| JP | 2005-220440 | A | 8/2005 | |
| JP | 2005-256115 | A | 9/2005 | |
| JP | 2005-298924 | A | 10/2005 | |
| JP | 2005-320619 | A | 11/2005 | |
| JP | 2006-274318 | A | 10/2006 | |
| JP | 2007-9322 | A | 1/2007 | |
| JP | 2007-138238 | A | 6/2007 | |
| JP | 2007-231399 | A | 9/2007 | |
| JP | 2007-247046 | A | 9/2007 | |
| JP | 2007-247049 | A | 9/2007 | |
| JP | 2007-314828 | A | 12/2007 | |
| JP | 2008-266726 | A | 11/2008 | |
| JP | 2008-285748 | A | 11/2008 | |
| JP | 2009-19265 | A | 1/2009 | |
| JP | 2009-24227 | A | 2/2009 | |
| JP | 2009-191360 | A | 8/2009 | |
| JP | 2009-270171 | A | 11/2009 | |
| JP | 2009-275238 | A | 11/2009 | |
| JP | 2010-168651 | A | 8/2010 | |
| JP | 2010-202976 | A | 9/2010 | |
| JP | 2010-248601 | A | 11/2010 | |
| JP | 2010-255090 | A | 11/2010 | |
| JP | 2011-140671 | A | 7/2011 | |
| JP | 2011-225941 | A | 11/2011 | |
| JP | 2012-26032 | A | 2/2012 | |
| JP | 2012-41573 | A | 3/2012 | |
| JP | 2012-62561 | A | 3/2012 | |
| JP | 2012-180569 | A | 9/2012 | |
| JP | 2012-251201 | A | 12/2012 | |
| JP | 2013-19048 | A | 1/2013 | |
| JP | 5240037 | B2 | 7/2013 | |
| JP | 2014-37595 | A | 2/2014 | |
| JP | 5445720 | B1 | 3/2014 | |
| JP | 2014-141703 | A | 8/2014 | |
| JP | 5574070 | B1 | 8/2014 | |
| JP | 5610103 | B2 | 10/2014 | |
| JP | 2015-124411 | A | 7/2015 | |
| JP | 2015-218352 | A | 12/2015 | |
| JP | 2016-50334 | A | 4/2016 | |
| KR | 10-2003-0076430 | A | 9/2003 | |
| KR | 10-0778264 | B1 | 9/2003 | |
| KR | 10-2009-0086401 | A | 8/2009 | |
| TW | 201245465 | A1 | 11/2012 | |
| TW | 201332673 | A1 | 8/2013 | |
| TW | 201413009 | A | 4/2014 | |
| TW | I467027 | B | 1/2015 | |
| TW | I470091 | B | 1/2015 | |
| WO | WO 2007/132548 | A1 | 11/2007 | |
| WO | WO 2008/056812 | A1 | 5/2008 | |
| WO | WO 2008/123366 | A1 | 10/2008 | |
| WO | WO 2010/131303 | A1 | 11/2010 | |
| WO | WO 2013/121963 | A1 | 8/2013 | |
| WO | WO 2013/150687 | A1 | 10/2013 | |
| WO | WO 2013/161090 | A1 | 10/2013 | |
| WO | WO-2014014120 | A1 * | 1/2014 | ..... C22C 38/00 |
| WO | WO 2014/019844 | A1 | 2/2014 | |
| WO | WO 2014/051005 | A1 | 4/2014 | |
| WO | WO 2014/171427 | A1 | 10/2014 | |
| WO | WO 2016/135896 | A1 | 9/2016 | |

OTHER PUBLICATIONS

JP-2012251201-A English language translation (Year: 2012).*

Extended European Search Report dated Aug. 13, 2018, in European Patent Application No. 15882644.6.

"Development of Production Technology for Ultra Fine Grained Steels", Nakayama Steel Works, Ltd., NFG Product Introduction, total 11 pages, http://www.nakayama-steel.co.jp/menu/product/nfg.html.

International Search Report for PCT/JP2015/054846 dated May 19, 2015.

Katoh et al., Seitetsu Kenkyu, 1984, No. 312, pp. 41-50.

Sugimoto et al., "Stretch-flangeability of a High-strength TRIP Type Bainitic Sheet Steel", ISIJ International, 2000, vol. 40, No. 9, pp. 920-926.

Takahashi, "Development of High Strength Steels for Automobiles", Nippon Steel Technical Report, 2003, No. 378, pp. 2-7.

Written Opinion of the International Searching Authority for PCT/JP2015/054846 (PCT/ISA/237) dated May 19, 2015.

English translation of the International Preliminary Report on Patentability and Written Opinion dated Aug. 31, 2017, in PCT International Application No. PCT/JP2015/054846.

Office Action dated Sep. 8, 2018, in Korean Patent Application No. 10-2017-7018427, with English translation.

Office Action dated Jun. 1, 2018, in Chinese Patent Application No. 201580075484.9.

U.S. Notice of Allowance, dated Apr. 17, 2020, for U.S. Appl. No. 15/551,863.

Chinese Office Action and Search Report for Application No. 201580076254.4, dated May 30, 2018, with an English translation.

Chinese Office Action and Search Report for Chinese Application No. 201680011657.5, dated Jun. 5, 2018, with English translation.

Chinese Office Action and Search Report, dated Jun. 25, 2018, for Chinese Application No. 201580076157.5, with an English translation of the Office Action.

English translation of the International Preliminary Report on Patentability and Written Opinion of the International Searching Authority (Forms PCT/IB/338, PCT/IB/373 and PCT/ISA/237), dated Feb. 14, 2019, for International Application No. PCT/JP2017/028478.

Extended European Search Report for European Application No. 17837115.9, dated Nov. 28, 2019.

Extended European Search Report dated Dec. 11, 2018, in European Patent Application No. 16752608.6.

Extended European Search Report, dated Aug. 13, 2018, for European Application No. 15882647.9.

Extended European Search Report, dated Dec. 19, 2018, for European Application No. 16755418.7.

Extended European Search Report, dated Nov. 29, 2019, for European Application No. 17837116.7.

Extended European Search Report, dated Sep. 12, 2018, for European Application No. 15883192.5.

International Preliminary Report on Patentability and English translation of the Written Opinion of the International Searching Authority for International Application No. PCT/JP2017/028477, dated Feb. 14, 2019.

International Preliminary Report on Patentability and Written Opinion of the International Searching Authority (forms PCT/IB/338, PCT/IB/373 and PCT/ISA/237), dated Sep. 8, 2017, for corresponding International Application No. PCT/JP2015/055455, with a Written Opinion translation.

International Search Report (form PCT/ISA/210), dated May 19, 2015, for International Application No. PCT/JP2015/055455, with an English translation.

(56) References Cited

OTHER PUBLICATIONS

International Search Report for PCT/JP2015/054860 dated May 19, 2015.
International Search Report for PCT/JP2015/054876 dated May 19, 2015.
International Search Report for PCT/JP2015/055464 dated May 19, 2015.
International Search Report for PCT/JP2016/055071 (PCT/ISA/210) dated May 17, 2016.
International Search Report for PCT/JP2016/055074 (PCT/ISA/210) dated May 17, 2016.
International Search Report for PCT/JP2017/028477 (PCT/ISA/210) dated Oct. 31, 2017.
International Search Report for PCT/JP2017/028478 (PCT/ISA/210) dated Oct. 31, 2017.
Kimura et al., "Misorientation Analysis of Plastic Deformation of Austenitic Stainless Steel by EBSD and X-Ray Diffraction Methods", Transactions of the Japan Society of Mechanical Engineers. A, vol. 71, No. 712, 2005, pp. 1722-1728.
Korean Notice of Allowance, dated Feb. 26, 2019, for Korean Application No. 10-2017-7023370, with an English translation.
Korean Office Action dated Nov. 7, 2018 for Korean Application No. 10-2017-7023367, with an English translation.
Korean Office Action for Korean Application No. 10-2017-7023370, dated Nov. 7, 2018, with an English translation.
Korean Office Action, dated Oct. 12, 2018, for Korean Application No. 10-2017-7024039, with an English translation.
Notice of Allowance dated Feb. 26, 2019, in Korean Patent Application No. 10-2017-7023367, with English translation.
Office Action for TW 105105137 dated Mar. 23, 2017.
Office Action dated May 30, 2018, in Chinese Patent Application No. 201680010703.X, with English translation.
Taiwanese Office Action issued in TW Patent Application No. 105105213 dated Mar. 23, 2017.
Taiwanese Office Action issued in TW Patent Application No. 105105214 dated Mar. 23, 2017.
U.S. Final Office Action, dated Aug. 20, 2019, issued in U.S. Appl. No. 15/551,171.
U.S. Final Office Action, dated Dec. 10, 2019, for U.S. Appl. No. 15/549,837.
U.S. Final Office Action, dated Sep. 18, 2019, for U.S. Appl. No. 15/549,093.
U.S. Notice of Allowance, dated Dec. 27, 2019, for U.S. Appl. No. 15/551,863.
U.S. Notice of Allowance, dated Jan. 10, 2020, for U.S. Appl. No. 15/549,093.
U.S. Notice of Allowance, dated Sep. 5, 2019, for U.S. Appl. No. 15/551,863.
U.S. Office Action, dated Apr. 29, 2019, for U.S. Appl. No. 15/549,093.
U.S. Office Action, dated Apr. 29, 2019, issued in U.S. Appl. No. 15/551,171.
U.S. Office Action, dated May 1, 2019, for U.S. Appl. No. 15/551,863.
U.S. Office Action, dated May 31, 2019, for U.S. Appl. No. 15/549,837.
Written Opinion of the International Searching Authority for PCT/JP2015/054860 (PCT/ISA/237) dated May 19, 2015.
Written Opinion of the International Searching Authority for PCT/JP2015/055455 (PCT/ISA/237) dated May 19, 2015.
Written Opinion of the International Searching Authority for PCT/JP2016/055071 (PCT/ISA/237) dated May 17, 2016.
Written Opinion of the International Searching Authority for PCT/JP2016/055074 (PCT/ISA/237) dated May 17, 2016.
Written Opinion of the International Searching Authority for PCT/JP2017/028477 (PCT/ISA/237) dated Oct. 31, 2017.
Written Opinion of the International Searching Authority for PCT/JP2017/028478 (PCT/ISA/237) dated Oct. 31, 2017.
U.S. Office Action, dated Mar. 17, 2020, for U.S. Appl. No. 15/551,171.
U.S. Notice of Allowance, dated Feb. 12. 2020, for U.S. Appl. No. 15/549,093.
U.S. Office Action, dated Mar. 2, 2020, for U.S. Appl. No. 16/312,222.
U.S. Office Action for U.S. Appl. No. 16/315,120 dated Feb. 11, 2021.
U.S. Appl. No. 15/549,093, filed Aug. 4, 2017.
U.S. Appl. No. 16/315,120, filed Jan. 3, 2019.
U.S. Appl. No. 16/312,222, filed Dec. 20, 2018.
U.S. Appl. No. 15/549,837, filed Aug. 9, 2017.
U.S. Appl. No. 15/551,171, filed Aug. 15, 2017.
U.S. Appl. No. 15/551,863, filed Aug. 17, 2017.

* cited by examiner

HOT-ROLLED STEEL SHEET

TECHNICAL FIELD

The present invention relates to a hot-rolled steel sheet and, in particular, to a hot-rolled steel sheet utilizing a transformation induced plasticity (TRIP) phenomenon.

BACKGROUND ART

In order to suppress an emission amount of carbon dioxide gas from an automobile, weight reduction of an automobile body using a high-strength steel sheet is put forward. Further, a high-strength steel sheet has come to be often used as well as a mild steel sheet for an automobile body in order also to secure safety of a passenger. To further forward the weight reduction of an automobile body in the future, it is necessary to increase a use strength level of a high-strength steel sheet more than before. Accordingly, it is necessary to improve local deformability for burring, for example, to use a high-strength steel sheet for underbody parts. However, generally when the strength of a steel sheet is increased, formability decreases, and uniform elongation important for drawing and bulging decreases.

High-strength steel sheets intended for improving a formability and so on are disclosed in Patent Literatures 1 to 11. However, even with these conventional techniques, a hot-rolled steel sheet having sufficient strength and sufficient formability cannot be obtained.

Besides, Non-Patent Literature 1 discloses a method of retaining austenite in a steel sheet to secure a uniform elongation. In addition, Non-Patent Literature 1 also discloses a metal structure control method of a steel sheet for improving local ductility required for bending forming, hole expanding, and burring. Further, Non-Patent Literature 2 discloses that controlling an inclusion, controlling microstructures into a single structure, and reducing a hardness difference between microstructures are effective for bendability and hole expanding.

In order to satisfy both the ductility and the strength, a technique of controlling metal structure by adjusting a cooling condition after hot-rolling so as to control precipitates and transformation structure to thereby obtain appropriate fractions of ferrite and bainite is also disclosed in Non-Patent Literature 3. However, any of the methods is an improving method for the local deformability depending on the structure control (control of the microstructures in terms of classification), so that the local deformability is greatly affected by a base structure.

On the other hand, Non-Patent Literature 4 discloses a method of improving quality of material of a hot-rolled steel sheet by increasing a reduction ratio in a continuous hot-rolling process. Such a technique is a so-called grain miniaturization technique, and a heavy reduction is performed at a temperature as low as possible in an austenite region to transform non-recrystallized austenite into ferrite, thereby miniaturizing grains of ferrite being a main phase of a product to increase the strength and toughness in Non-Patent Literature 4. However, in the manufacturing method disclosed in Non-Patent Literature 4, improvement of the local deformability and ductility is not taken into consideration at all.

As described above, control of the structure including an inclusion has been mainly performed to improve the local deformability of the high-strength steel sheet.

Besides, to use a high-strength steel sheet as a member for an automobile, a balance between the strength and the ductility is needed. For such a need, a so-called TRIP steel sheet utilizing the transformation-induced plasticity of retained austenite has been proposed so far (refer to, for example, Patent Literatures 13 and 14).

However, a TRIP steel sheet is excellent in strength and ductility but has such a feature that the local deformability represented by the hole expandability relating to stretch-flangeability is generally low. Therefore, for using a TRIP steel sheet, for example, as a high-strength steel sheet for underbody parts, the local deformability has to be improved.

CITATION LIST

Patent Literature

Patent Literature 1: Japanese Laid-open Patent Publication No. 2012-26032

Patent Literature 2: Japanese Laid-open Patent Publication No. 2011-225941

Patent Literature 3: Japanese Laid-open Patent Publication No. 2006-274318

Patent Literature 4: Japanese Laid-open Patent Publication No. 2005-220440

Patent Literature 5: Japanese Laid-open Patent Publication No. 2010-255090

Patent Literature 6: Japanese Laid-open Patent Publication No. 2010-202976

Patent Literature 7: Japanese Laid-open Patent Publication No. 2012-62561

Patent Literature 8: Japanese Laid-open Patent Publication No. 2004-218077

Patent Literature 9: Japanese Laid-open Patent Publication No. 2005-82841

Patent Literature 10: Japanese Laid-open Patent Publication No. 2007-314828

Patent Literature 11: Japanese National Publication of International Patent Application No. 2002-534601

Patent Literature 12: International Publication No. WO 2014/171427

Patent Literature 13: Japanese Laid-open Patent Publication No. 61-217529

Patent Literature 14: Japanese Laid-open Patent Publication No. 5-59429

Non-Patent Literature

Non-Patent Literature 1:Takahashi, Nippon Steel Technical Report (2003) No. 378, p. 7

Non-Patent Literature 2: Kato, et al., Seitetsu Kenkyu (1984) No. 312, p. 41

Non-Patent Literature 3: K. Sugimoto et al., ISIJ International (2000) Vol. 40, p. 920

Non-Patent Literature 4: NAKAYAMA STEEL WORKS, LTD. NFG Product Introduction

SUMMARY OF INVENTION

Technical Problem

An object of the present invention is to provide a hot-rolled steel sheet capable of securing excellent ductility utilizing TRIP phenomenon and obtaining excellent stretch-flangeability while having high strength.

Solution to Problem

The present inventors with an eye on a general manufacturing method of a hot-rolled steel sheet implemented in an industrial scale by using a common continuous hot-rolling mill, earnestly studies in order to improve the formability such as ductility and stretch-flangeability of the hot-rolled steel sheet while obtaining high strength. As a result, the present inventors have found a new structure extremely effective in securing the high strength and improving the formability, the structure not having been formed by a conventional technique. This structure is not a structure recognized in an optical microscope observation but is recognized based on intragranular misorientation of each grain. This structure is, concretely, a structure composed of grains having an average intragranular misorientation of 5° to 14° when a grain is defined as an area which is surrounded by a boundary having a misorientation of 15° or more and has a circle-equivalent diameter of 0.3 μm or more. Hereinafter, this structure is sometimes referred to as a "newly recognized structure". The present inventors have newly found that controlling the proportion of the newly recognized structure in a specific range makes it possible to greatly improve the stretch-flangeability while keeping the excellent ductility of TRIP steel.

Further, the newly recognized structure cannot be formed by conventional methods such as the methods disclosed in the above Patent Literatures 1 to 13. For example, a conventional technique of increasing a cooling rate from the end of so-called intermediate cooling to winding to form martensite so as to increase strength cannot form the newly recognized structure. Bainite contained in a conventional thin steel sheet is composed of bainitic ferrite and iron carbide, or composed of bainitic ferrite and retained austenite. Therefore, in the conventional thin steel sheet, the iron carbide or retained austenite (or martensite having been transformed by being processed) promotes development of a crack in hole expansion. Therefore, the newly recognized structure has local ductility better than that of bainite contained in the conventional thin steel sheet. Further, the newly recognized structure is a structure different also from ferrite included in a conventional thin steel sheet. For example, a generating temperature of the newly recognized structure is equal to or lower than a bainite transformation start temperature estimated from components of the steel, and a grain boundary with a low tilt angle exists inside a grain surrounded by a high-angle grain boundary of the newly recognized structure. The newly recognized structure has a feature different from that of ferrite at least in the above points.

Though details will be described later, the present inventors have found that the newly recognized structure can be formed with a specific proportion together with ferrite, bainite, and retained austenite by making conditions of hot-rolling, cooling thereafter, winding thereafter, and so on be proper ones. Note that by the methods disclosed in Patent Literatures 1 to 3, it is impossible to generate the newly recognized structure having a grain boundary with a low tilt angle inside a grain surrounded by a high-angle grain boundary, since a cooling rate after the end of intermediate air cooling and before winding, and a cooling rate in a state of being wound are extremely high.

The present inventors have earnestly studied based on the above findings, and reached various aspects of the invention described below.

(1)

A hot-rolled steel sheet, comprising:

a chemical composition represented by, in mass %:

C: 0.06% to 0.22%;
Si: 1.0% to 3.2%;
Mn: 0.8% to 2.2%;
P: 0.05% or less;
S: 0.005% or less;
Al: 0.01% to 1.00%;
N: 0.006% or less;
Cr: 0.00% to 1.00%;
Mo: 0.000% to 1.000%;
Ni: 0.000% to 2.000%;
Cu: 0.000% to 2.000%;
B: 0.0000% to 0.0050%;
Ti: 0.000% to 0.200%;
Nb: 0.000% to 0.200%;
V: 0.000% to 1.000%;
W: 0.000% to 1.000%;
Sn: 0.0000% to 0.2000%;
Zr: 0.0000% to 0.2000%;
As: 0.0000% to 0.5000%;
Co: 0.0000% to 1.0000%;
Ca: 0.0000% to 0.0100%;
Mg: 0.0000% to 0.0100%;
REM: 0.0000% to 0.1000%; and
balance: Fe and impurities; and a microstructure represented by, in vol %:

retained austenite: 2% to 30%;
ferrite: 20% to 85%;
bainite: 10% to 60%;
pearlite: 5% or less; and
martensite: 10% or less, wherein a proportion of grains having an intragranular misorientation of 5° to 14° in all grains is 5% to 50% by area ratio, the grain being defined as an area which is surrounded by a boundary having a misorientation of 15° or more and has a circle-equivalent diameter of 0.3 μm or more.

(2)

The hot-rolled steel sheet according to (1), wherein, in the chemical composition, Cr: 0.05% to 1.00% is satisfied.

(3)

The hot-rolled steel sheet according to or (2), wherein, in the chemical composition, Mo: 0.001% to 1.000%,
Ni: 0.001% to 2.000%,
Cu: 0.001% to 2.000%,
B: 0.0001% to 0.0050%,
Ti: 0.001% to 0.200%,
Nb: 0.001% to 0.200%,
V: 0.001% to 1.000%,
W: 0.001% to 1.000%,
Sn: 0.0001% to 0.2000%,
Zr: 0.0001% to 0.2000%,
As: 0.0001% to 0.5000%,
Co: 0.0001% to 1.0000%,
Ca: 0.0001% to 0.0100%,
Mg: 0.0001% to 0.0100%, or
REM: 0.0001% to 0.1000%, or
any combination thereof is satisfied.

Advantageous Effects of Invention

According to the present invention, it is possible to obtain excellent ductility and excellent stretch-flangeability while having high strength.

DESCRIPTION OF EMBODIMENTS

Hereinafter, embodiments of the present invention will be described.

Figure 1:
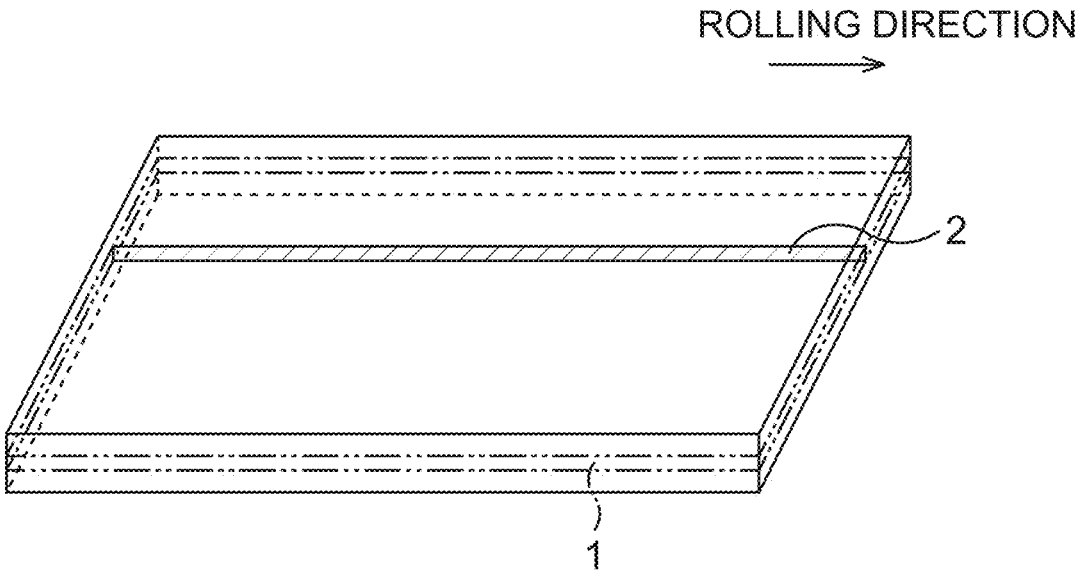
FIG. 1 is a view illustrating a region which represents a microstructure of a hot-rolled steel sheet.

First, characteristics of a microstructure and a grain in a hot-rolled steel sheet according to the present embodiment will be described. The hot-rolled steel sheet according to the present embodiment includes a microstructure represented by retained austenite: 2% to 30%, ferrite: 20% to 85%, bainite: 10% to 60%, pearlite: 5% or less, and martensite: 10% less. In the hot-rolled steel sheet according to the present embodiment, a proportion of grains having an intragranular misorientation of 5° to 14° in all grains is 5% to 50% by area ratio, when a grain is defined as an area which is surrounded by a boundary having a misorientation of 15° or more and has a circle-equivalent diameter of 0.3 μm or more. In the following description, "%" that is a unit of the proportion of each phase and structure included in the hot-rolled steel sheet means "vol %" unless otherwise stated. The microstructure in the hot-rolled steel sheet can be represented by a microstructure in a region from the surface of the hot-rolled steel sheet to ⅜ to ⅝ of the thickness of the hot-rolled steel sheet. This region 1 is illustrated in FIG. 1. FIG. 1 also illustrates a cross section 2 being an object where ferrite and others are observed.

As described below, according to the present embodiment, it is possible to obtain a hot-rolled steel sheet that is applicable to a part required to have bulging formability relating to strict ductility and stretch-flangeability relating to local ductility while having high strength. For example, it is possible to obtain a strength of 590 MPa or more and a stretch-flangeability that a product (H×TS) of a flange height H (mm) and a tensile strength TS (MPa) in a saddle-type stretch-flange test method with a curvature radius R of a corner sot to 50 mm to 60 mm is 19500 (mm·MPa) or more.

Figure 2A:
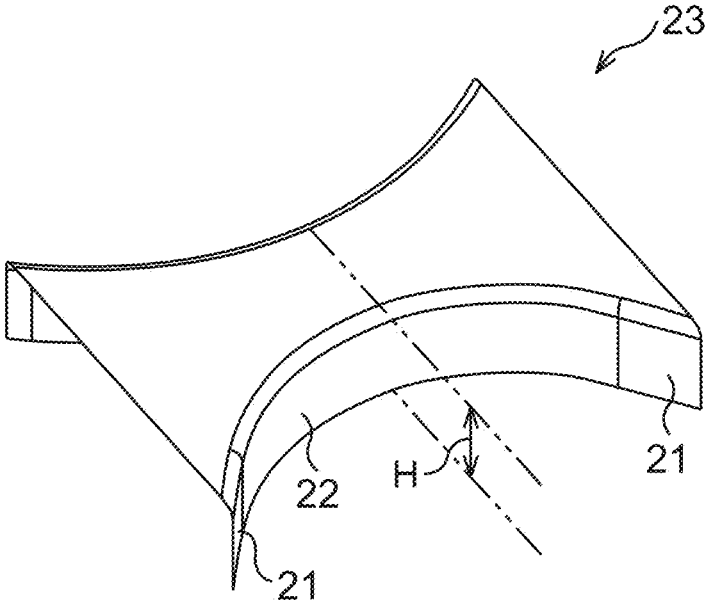
FIG. 2A is a diagrammatic perspective view illustrating a saddle-type stretch-flange test.
Figure 2B:
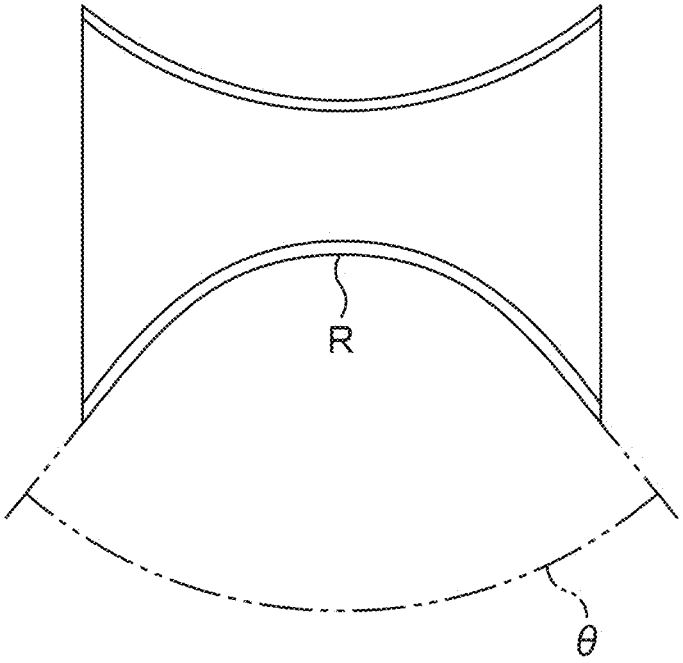
FIG. 2B is a top view illustrating the saddle-type stretch-flange test.

The stretch-flangeability can be evaluated using the flange height H (mm) in the saddle-type stretch-flange test method (the curvature radius R of a corner: 50 mm to 60 mm). The saddle-type stretch-flange test method is described. The saddle-type stretch-flange test is a method in which a saddle-shaped formed product 23 is press-formed in simulating a stretch-flange shape including a straight part 21 and an arc part 22 as illustrated in FIG. 2A and FIG. 2B and the stretch-flangeability is evaluated by a limit form height at that time. In the present embodiment, the limit form height obtained when the curvature radius R of the arc part 22 is set to 50 mm to 60 mm, an opening angle θ is set to 120°, and a clearance when punching the arc part 22 is set to 11%, is used as the flange height H (mm). Determination of the limit form height is visually made based on the presence or absence of cracks having a length of ⅓ or more of the sheet thickness after forming. In the conventional hole expansion test used as a test method coping with the stretch-flangeability, since the sheet leads to a fracture with little or no strain distributed in a circumferential direction, evaluation is made at the point in time when a fracture occurs penetrating the sheet thickness, different in strain and in stress gradient around a fractured portion from the time of an actual stretch-flange forming. Accordingly, the hole expansion test cannot be said to be an evaluation method reflecting an actual stretch-flange forming. The saddle-type stretch-flange test method is described also in, for example, a document (Yoshida, et al., Nippon Steel Technical Report (2012) No. 393, p. 18).

A proportion of grains having an intragranular misorientation of 5° to 14° in all grains can be measured by the following method. First, a crystal orientation of a rectangular region having a length in a rolling direction (RD) of 200 μm and a length in a normal direction (ND) of 100 μm around a ¼ depth position (¼t portion) of a sheet thickness t from the surface of the steel sheet within a cross section parallel to the rolling direction, is analyzed by an electron back scattering diffraction (EBSD) method at intervals of 0.2 μm, and crystal orientation information on this rectangular region is acquired. This analysis is performed at a speed of 200 points/sec to 300 points/sec using, for example, a thermal electric field emission scanning electron microscope (JSM-7001F manufactured by JOEL Ltd.) and an EBSD analyzer equipped with an EBSD detector (HIKARI detector manufacture by TSL Co., Ltd.). Then, a grain is defined as a region surrounded by a boundary having a misorientation of 15° or more and having a circle-equivalent diameter of 0.3 μm or more from the acquired crystal orientation information, the intragranular misorientation is calculated, and the proportion of grains having an intragranular misorientation of 5° to 14° in all grains is obtained. The thus-obtained proportion is an area fraction, and is equivalent also to a volume fraction. The "intragranular misorientation" means "Grain Orientation Spread (GOS)" being an orientation spread in a grain. The intragranular misorientation is obtained as an average value of misorientation between the crystal orientation being a base and crystal orientations at all measurement points in the grain as described also in a document "KIMURA Hidehiko, WANG Yun, AKINIWA Yoshiaki, TANAKA Keisuke "Misorientation Analysis of Plastic Deformation of Stainless Steel by EBSD and X-ray Diffraction Methods", Transactions of the Japan Society of Mechanical Engineers. A, Vol. 71, No. 712, 2005, pp. 1722-1728." Besides, an orientation obtained by averaging the crystal orientations at all of the measurement points in the grain is used as "the crystal orientation being a base". The intragranular misorientation can be calculated, for example, by using software "OIM Analysis™ Version 7.0.1" attached to the EBSD analyzer.

Figure 3A:
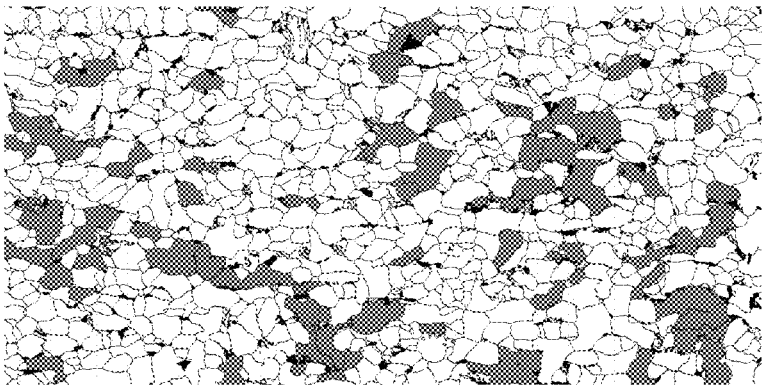
FIG. 3A is a view illustrating an EBSD analysis result of an example of a hot-rolled steel sheet.
Figure 3B:
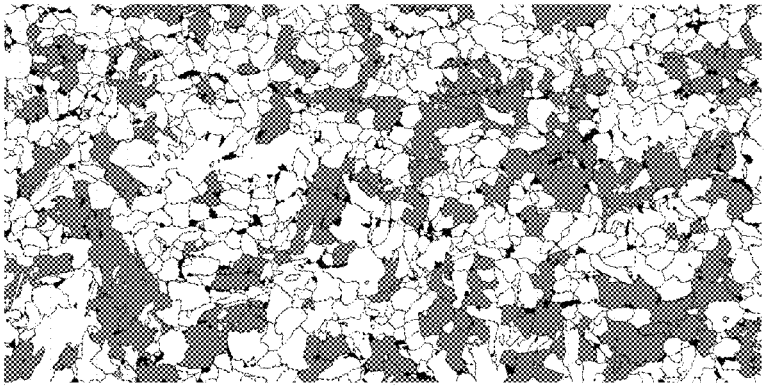
FIG. 3B is a view illustrating an EBSD analysis result of an example of a hot-rolled steel sheet.

Examples of the EBSD analysis results are illustrated in FIG. 3A and FIG. 3B. FIG. 3A illustrates an analysis result of a TRIP steel sheet having a tensile strength of 590 MPa class, and FIG. 3B illustrates an analysis result of a TRIP steel sheet having a tensile strength of 780 MPa class. Gray regions in FIG. 3A and FIG. 3B indicate grains having an intragranular misorientation of 5° to 14°. White regions indicate grains having an intragranular misorientation of less than 5° or more than 14°. Black regions indicate regions where the intragranular misorientation was not able to be analyzed. The results as illustrated in FIG. 3A and FIG. 3B are obtained by the EBSD analysis, so that the proportion of the grains having an intragranular misorientation of 5° to 14° can be specified based on the results.

The crystal orientation in a grain is considered to have a correlation with a dislocation density included in the grain. Generally, an increase in dislocation density in a grain brings about improvement in strength while decreasing workability. However, the grains having an intragranular misorientation of 5° to 14° can improve the strength without decreasing workability. Therefore, in the hot-rolled steel sheet according to the present embodiment, the proportion of the grains having an intragranular misorientation of 5° to 14° is 5% to 50% as described below. A grain having an intragranular misorientation of less than 5° is difficult to increase the strength though excellent in workability. A grain having an average misorientation in the grain of more than 14° does not contribute to improvement of stretch-flangeability because it is different in deformability in the grain. Note that a crystal structure of retained austenite contained in a microstructure is a face-centered cubic (fcc) structure and is excluded from measurement of the GOS in a body-centered cubic (bcc) structure in the present invention. However, the proportion of the "grains having an intragranular misorientation of 5° to 14° " in the present invention is defined as a value obtained by first subtracting the proportion of retained austenite from 100% and then subtracting the proportion of grains other than the "grains having an intragranular misorientation of 5° to 14° " from the result of the above subtraction.

The grain having an intragranular misorientation of 5° to 14° can be obtained by a later-described method. As described above, the present inventors have found that the grain having an intragranular misorientation of 5° to 14° is very effective for securing high strength and improving formability such as stretch-flangeability and so on. The grain having an intragranular misorientation of 5° to 14° contains little or no carbide in the grain. In other words, the grain having an intragranular misorientation of 5° to 14° contains little or no matter that promotes development of a crack in stretch-flange forming. Accordingly, the grain having an intragranular misorientation of 5° to 14° contributes to securement of high strength and improvement of ductility and stretch-flangeability.

When the proportion of the grains having an intragranular misorientation of 5° to 14° is less than 5% by area ratio, sufficient strength cannot be obtained. Accordingly, the proportion of the grains having an intragranular misorientation of 5° to 14° is 5% or more. On the other hand, when the proportion of the grains having an intragranular misorientation of 5° to 14° is more than 50% by area ratio, sufficient ductility cannot be obtained. Accordingly, the proportion of the grains having an intragranular misorientation of 5° to 14° is 50% or less. When the proportion of the grains having an intragranular misorientation of 5° to 14° is 5% or more and 50% or less, generally, the tensile strength is 590 MPa or more, and the product (H×TS) of the flange height H (mm) and the tensile strength TS (MPa) is 19500 (mm·MPa) or more. These characteristics are preferable for working underbody parts of an automobile.

The grain having an intragranular misorientation of 5° to 14° is effective for obtaining a steel sheet excellent in balance between the strength and the workability. Accordingly, setting a structure composed of such grains, namely, a newly recognized structure to a predetermined range, that is, 5% to 50% by area ratio in the present embodiment makes it possible to greatly improve the stretch-flangeability while keeping desired strength and ductility.

(Retained austenite: 2% to 30%)

Retained austenite contributes to the ductility relating to the bulging formability. When retained austenite is less than 2%, sufficient ductility cannot be obtained. Accordingly, the proportion of retained austenite is 2% or more. On the other hand, when the proportion of retained austenite is more than 30%, development of a crack is promoted at an interface with ferrite or bainite in stretch-flange forming to decrease the stretch-flangeability. Accordingly, the proportion of retained austenite is 30% or less. When the proportion of retained austenite is 30% or less, the product (H×TS) of the flange height H (mm) and the tensile strength TS (MPa) is generally 19500 (mm·MPa) or more, which is preferable for working underbody parts of an automobile.

(Ferrite: 20% to 85%)

Ferrite exhibits excellent deformability and improves uniform ductility. When the proportion of ferrite is less than 20%, excellent uniform ductility cannot be obtained. Accordingly, the proportion of ferrite is 20% or more. Further, ferrite is generated in cooling after the end of hot-rolling and makes carbon (C) denser in retained austenite, and is therefore necessary to improve the ductility by the TRIP effect. However, when the proportion of ferrite is more than 85%, the stretch-flangeability greatly decreases. Accordingly, the proportion of ferrite is 85% or less.

(Bainite: 10% to 60%)

Bainite is generated after winding and makes C denser in retained austenite, and is therefore necessary to improve the ductility by the TRIP effect. Further, bainite also contributes to improvement of hole expandability. The fractions of ferrite and bainite may be adjusted according to the strength level that is the target of development, but when the proportion of bainite is less than 10%, the effect by the above action cannot be obtained. Accordingly, the proportion of bainite is 10% or more. On the other hand, when the proportion of bainite is more than 60%, the uniform elongation decreases. Accordingly, the proportion of bainite is 60% or less.

(Pearlite: 5% or less)

Pearlite becomes an origin of a crack in stretch-flange forming and decreases the stretch-flangeability. When pearlite is more than 5%, such a decrease in stretch-flangeability is prominent. When pearlite is 5% or less, the product (H×TS) of the flange height H (mm) and the tensile strength TS (MPa) is generally 19500 (mm·MPa) or more, which is preferable for working underbody parts of an automobile.

(Martensite: 10% or less)

Martensite promotes development of a crack at an interface with ferrite or bainite in stretch-flange forming to decrease the stretch-flangeability. When martensite is more than 10%, such a decrease in stretch-flangeability is prominent. When martensite is 10% or less, the product (H×TS) of the flange height H (mm) and the tensile strength TS (MPa) is generally 19500 (mm·MPa) or more, which is preferable for working underbody parts of an automobile.

Each volume ratio of a structure observed in an optical microstructure such as ferrite and bainite in the hot-rolled steel sheet and the proportion of the grains having an intragranular misorientation of 5° to 14° have no direct relation. In other words, for example, even if there are a plurality of hot-rolled steel sheets having the same ferrite volume ratio, bainite volume ratio, and retained austenite volume ratio, the proportions of the grains having an intragranular misorientation of 5° to 14° are not necessarily the same among the plurality of hot-rolled steel sheets. Accordingly, it is impossible to obtain characteristics corresponding to the hot-rolled steel sheet according to the present embodiment only by controlling the ferrite volume ratio, bainite volume ratio, and retained austenite volume ratio.

As a matter of course, it is preferable to satisfy the conditions relating to the above-described phases and structures not only in the region from the surface of the hot-rolled steel sheet to ⅜ to ⅝ of the thickness of the hot-rolled steel sheet but also in a wider range, and as the range satisfying the conditions is wider, better strength and workability can be obtained.

The proportions (volume fractions) of ferrite, bainite, pearlite, and martensite are equivalent to area ratios in the cross section 2 parallel to the rolling direction in the region from the surface of the hot-rolled steel sheet to ⅜ to ⅝ of its thickness. The area ratio in the cross section 2 can be measured by cutting out a sample from a 1/4 W or 3/4 W position of the sheet width of the steel sheet, polishing a surface parallel to the rolling direction of the sample, etching it using a nital reagent, and observing the sample using an optical microscope at a magnification of 200 times to 500 times.

Retained austenite can be crystallographically easily distinguished from ferrite because it is different in crystal structure from ferrite. Accordingly, the proportion of retained austenite can be also experimentally obtained by the X-ray diffraction method using a property that the reflection plane intensity is different between austenite and ferrite. In other words, a proportion $V\gamma$ of retained austenite can be obtained using the following expression from an image obtained by the X-ray diffraction method using a $K\alpha$ ray of Mo.

$$V\gamma=(2/3)\{100/(0.7\times\alpha(211)/\gamma(220)+1)\}+(1/3)\{100/(0.78\times\alpha(211)/\gamma(311)+1)\}$$

Here, $\alpha$(211) is a reflection plane intensity at a (211) plane of ferrite, $\gamma$(220) is a reflection plane intensity at a (220) plane of austenite, and $\gamma$(311) is a reflection plane intensity at a (311) plane of austenite.

The proportion of retained austenite can also be measured by optical microscope observation under the above-described conditions using an agent described in Japanese Laid-open Patent Publication No. 5-163590. Since approximately consistent values can be obtained even when using any of the methods such as the optical microscope observation and the X-ray diffraction method, a value obtained using any one of the methods may be used.

Next, chemical compositions of the hot-rolled steel sheet according to the embodiment of the present invention and a steel ingot or slab used for manufacturing the hot-rolled steel sheet will be described. Though details will be described later, the hot-rolled steel sheet according to the embodiment of the present invention is manufactured through hot-rolling of the ingot or slab, cooling thereafter, winding thereafter and others. Accordingly, the chemical compositions of the hot-rolled steel sheet and the slab are ones in consideration of not only characteristics of the hot-rolled steel sheet but also the above-stated processing. In the following description, "%" being a unit of a content of each element contained in the hot-rolled steel sheet means "mass %" unless otherwise stated. The hot-rolled steel sheet according to the present embodiment includes a chemical composition represented by: C: 0.06% to 0.22%, Si: 1.0% to 3.2%, Mn: 0.8% to 2.2%, P: 0.05% or less, S: 0.005% or less, Al: 0.01% to 1.00%, N: 0.006% or less, Cr: 0.00% to 1.00%, Mo: 0.000% to 1.000%, Ni: 0.000% to 2.000%, Cu: 0.000% to 2.000%, B: 0.0000% to 0.0050%, Ti: 0.000% to 0.200%, Nb: 0.000% to 0.200%, V: 0.000% to 1.000%, W: 0.000% to 1.000%, Sn: 0.0000% to 0.2000%, Zr: 0.0000% to 0.2000%, As: 0.0000% to 0.5000%, Co: 0.0000% to 1.0000%, Ca: 0.0000% to 0.0100%, Mg: 0.0000% to 0.0100%, rare earth metal (REM): 0.0000% to 0.1000%, and balance: Fe and impurities. Examples of the impurities include one contained in raw materials such as ore and scrap, and one contained during a manufacturing process.

(C: 0.06% to 0.22%)

C forms various precipitates in the hot-rolled steel sheet and contributes to improvement of the strength by precipitation strengthening. C also contributes to securement of retained austenite, which improves the ductility. When a C content is less than 0.06%, sufficient retained austenite cannot be secured, failing to obtain sufficient strength and ductility. Therefore, the C content is 0.06% or more. From the viewpoint of further improvement of the strength and the elongation, the C content is preferably 0.10% or more. On the other hand, when the C content is more than 0.22%, sufficient stretch-flangeability cannot be obtained or weldability is impaired. Therefore, the C content is 0.22% or less. To further improve the weldability, the C content is preferably 0.20% or less.

(Si: 1.0% to 3.2%)

Si stabilizes ferrite in temperature control after hot-rolling and suppresses precipitation of cementite after winding (in bainite transformation). Thus, Si increases the C concentration of austenite to contribute to securement of retained austenite. When an Si content is less than 1.0%, the above effects cannot be obtained sufficiently. Therefore, the Si content is 1.0% or more. On the other hand, when the Si content is more than 3.2%, surface property, paintability, and weldability are deteriorated. Therefore, the Si content is 3.2% or less.

(Mn: 0.8% to 2.2%)

Mn is an element that stabilizes austenite and enhances hardenability. When a Mn content is less than 0.8%, sufficient hardenability cannot be obtained. Therefore, the Mn content is 0.8% or more. On the other hand, when the Mn content is more than 2.2%, a slab fracture occurs. Therefore, the Mn content is 2.2% or less.

(P: 0.05% or less)

P is not an essential element and is contained, for example, as an impurity in the steel. From the viewpoint of workability, weldability, and fatigue characteristic, a lower P content is more preferable. In particular, when the P content is more than 0.05%, the decreases in workability, weldability, and fatigue characteristic are prominent. Therefore, the P content is 0.05% or less.

(S: 0.005% or less)

S is not an essential element and is contained, for example, as an impurity in the steel. With a higher S content, an A type inclusion leading to decrease in stretch-flangeability becomes more likely to be generated, and therefore a lower S content is more preferable. In particular, with an S content of more than 0.005%, the decrease in stretch-flangeability is prominent. Therefore, the S content is 0.005% or less.

(Al: 0.01% to 1.00%)

Al is a deoxidizer, and when an Al content is less than 0.01%, sufficient deoxidation cannot be performed in a current general refining (including secondary refining). Therefore, the Al content is 0.01% or more. Al stabilizes ferrite in temperature control after the hot-rolling and suppresses precipitation of cementite in bainite transformation. Thus, Al increases the C concentration of austenite to contribute to securement of retained austenite. On the other hand, when the Al content is more than 1.00%, the surface property, paintability, and weldability are deteriorated. Therefore, the Al content is 1.00% or less. To obtain more stabilized retained austenite, the Al content is preferably 0.02% or more.

Si also functions as a deoxidizer. Further, as described above, Si and Al increase the C concentration of austenite to contribute to securement of retained austenite. However, when the sum of the Si content and the Al content is more than 4.0%, the surface property, paintability, and weldability are likely to be deteriorated. Therefore, the sum of the Si content and the Al content is preferably 4.0% or less. Further, to obtain better paintability, the sum is preferably 3.5% or less, and more preferably 3.0% or less.

(N: 0.006% or less)

N is not an essential element but is contained, for example, as an impurity in the steel. From the viewpoint of workability, a lower N content is more preferable. In particular, with an N content of more than 0.006%, the decrease in workability is prominent. Therefore, the N content is 0.006% or less.

(Cr: 0.00% to 1.00%)

Cr is not an essential element but is an optional element which may be contained as needed in the hot-rolled steel sheet up to a specific amount for suppressing pearlite transformation to stabilize retained austenite. To sufficiently obtain this effect, a Cr content is preferably 0.05% or more, more preferably 0.20%, and furthermore preferably 0.40%. On the other hand, when the Cr content is more than 1.00%, the effect by the above action is saturated, resulting in not only that the cost unnecessarily increases but also that a decrease in conversion treatment is prominent. Therefore, the Cr content is 1.00% or less. In other words, Cr: 0.05% to 1.00% is preferably satisfied.

Mo, Ni, Cu, B, Ti, Nb, V, W, Sn, Zr, As and Co are not essential elements but are optional elements which may be contained as needed in the hot-rolled steel sheet up to specific amounts.

(Mo: 0.000% to 1.000% Ni: 0.000% to 2.000%, Cu: 0.000% to 2.000%, B: 0.0000% to 0.0050%, Ti: 0.000% to 0.200%, Nb: 0.000% to 0.200%, V: 0.000% to 1.000%, W: 0.000% to 1.000%, Sn: 0.0000% to 0.2000%, Zr: 0.0000% to 0.2000%, As: 0.0000% to 0.5000%, Co: 0.0000% to 1.0000%)

Mo, Ni, Cu, B, Ti, Nb, V, W, Sn, Zr, As and Co contribute to further improvement of the strength of the hot-rolled steel sheet by precipitation hardening or solid solution strengthening. Therefore, Mo, Ni, Cu, B, Ti, Nb, V, W, Sn, Zr, As or Co or any combination thereof may be contained. To sufficiently obtain this effect, Mo: 0.001% or more, Ni: 0.001% or more, Cu: 0.001% or more, B: 0.0001% or more, Ti: 0.001% or more, Nb: 0.001% or more, V: 0.001% or more, W: 0.001% or more, Sn: 0.0001% or more, Zr: 0.0001% or more, As: 0.0001% or more %, or Co: 0.0001% or more, or any combination thereof is preferably satisfied. However, with Mo: more than 1.000%, Ni: more than 2.000%, Cu: more than 2.000%, B: more than 0.0050%, Ti: more than 0.200%, Nb: more than 0.200%, V: more than 1.000%, W: more than 1.000%, Sn: more than 0.2000%, Zr: more than 0.2000%, As: more than 0.5000%, or Co: more than 1.0000%, or any combination thereof, the effect by the above action is saturated, resulting in that the cost unnecessarily increases. Therefore, the Mo content is 1.000% or less, the Ni content is 2.000% or less, the Cu content is 2.000% or less, the B content is 0.0050%, the Ti content is 0.200% or less, the Nb content is 0.200% or less, the V content is 1.000% or less, the W content is 1.000% or less, the Sn content is 0.2000% or less, the Zr content is 0.2000% or less, the As content is 0.5000% or less, and the Co content is 1.0000% or less. In other words, Mo: 0.001% to 1.000%, Ni: 0.001% to 2.000%, Cu: 0.001% to 2.000%, B: 0.0001% to 0.0050%, Ti: 0.001% to 0.200%, Nb: 0.001% to 0.200%, V: 0.001% to 1.000%, W: 0.001% to 1.000%, Sn: 0.0001% to 0.2000%, Zr: 0.0001% to 0.2000%, As: 0.0001% to 0.5000%, or Co: 0.0001% to 1.0000%, or any combination thereof is preferably satisfied.

(Ca: 0.0000% to 0.0100%, Mg: 0.0000% to 0.0100%, REM: 0.0000% to 0.1000%)

Ca, Mg, and REM change a form of a non-metal inclusion which becomes an origin of breakage or deteriorates the workability, thereby making the non-metal inclusion harmless. Therefore, Ca, Mg, or REM or any combination thereof may be contained. To sufficiently obtain this effect, Ca: 0.0001% or more, Mg: 0.0001% or more, or REM: 0.0001% or more, or any combination thereof is preferably satisfied. However, with Ca: more than 0.0100%, Mg: more than 0.0100%, or REM: more than 0.1000%, or any combination thereof, the effect by the above action is saturated, resulting in that the cost unnecessarily increases. Therefore, the Ca content is 0.0100% or less, the Mg content is 0.0100% or less, and the REM content is 0.1000% or less. In other words, Ca: 0.0001% to 0.0100%, Mg: 0.0001% to 0.0100%, or REM: 0.0001% to 0.1000%, or any combination thereof is preferably satisfied.

REM (rare earth metal) represents elements of 17 kinds in total of Sc, Y, and lanthanoid, and the "REM content" means a content of a total of these 17 kinds of elements. Lanthanoid is industrially added, for example, in a form of misch metal.

Next, an example of a method of manufacturing the hot-rolled steel sheet according to the embodiment will be described. The method described here can manufacture the hot-rolled steel sheet according to the embodiment, but a method of manufacturing the hot-rolled steel sheet according to the embodiment is not limited to this. More specifically, even a hot-rolled steel sheet manufactured by another method can be said to fall within the scope of the embodiment as long as they have grains satisfying the above conditions, microstructure, and chemical composition.

Figure 4:
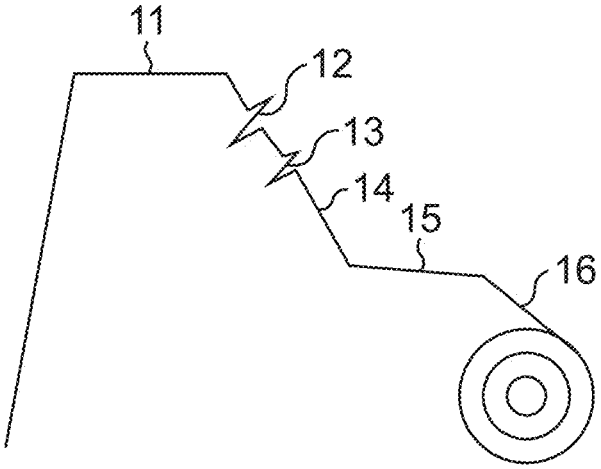
FIG. 4 is a view illustrating an outline of a temperature history from hot-rolling to winding.

This method performs the following processing in order. The outline of a temperature history from the hot-rolling to the winding is illustrated in FIG. 4.

(1) A steel ingot or slab having the above chemical composition is casted, and reheating 11 is performed as needed.

(2) Rough rolling 12 of the steel ingot or slab is performed. The rough rolling is included in hot-rolling.

(3) Finish rolling 13 of the steel ingot or slab is performed. The finish rolling is included in the hot-rolling. In the finish rolling, rolling in the last three stages is performed with a cumulative strain of more than 0.6 and 0.7 or less, and a finish temperature is an Ar3 point or higher and the Ar3 point +30° C. or lower.

(4) Cooling (first cooling) 14 down to a temperature of 650° C. or higher and 750° C. or lower is performed on a run out table at an average cooling rate of 10° C/sec or more.

(5) Air cooling 15 is performed for a time period of 3 seconds or more and 10 second or less. In this cooling, ferrite transformation occurs in a dual-phase region and excellent ductility is obtained.

(6) Cooling (second cooling) 16 down to a temperature of 350° C. or higher and 450° C. or lower is performed at an average cooling rate of 30° C/sec or more.

(7) Winding 17 is performed.

In casting of the steel ingot or slab, molten steel whose components are adjusted to have a chemical composition within a range described above is casted. Then, the steel ingot or slab is sent to a hot rolling mill. The casted steel ingot or slab kept at high temperature may be directly sent to the hot rolling mill, or may be cooled to room temperature, thereafter reheated in a heating furnace, and sent to the hot rolling mill. A temperature of the reheating 11 is not limited in particular. When the temperature of the reheating 11 is 1260° C. or higher, an amount of scaling off increases and sometimes reduces a yield, and therefore the temperature of the reheating 11 is preferably lower than 1260° C. Further, when the temperature of the reheating 11 is lower than 1000° C., an operation efficiency is sometimes impaired significantly in terms of schedule, and therefore the temperature of the reheating 11 is preferably 1000° C. or higher.

When the rolling temperature in the last stage of the rough rolling 12 is lower than 1080° C., that is, when the rolling temperature is decreased to lower than 1080° C. during the rough rolling 12, an austenite grain after the finish rolling 13 sometimes becomes excessively small and transformation from austenite to ferrite is excessively promoted, so that specific bainite is sometimes difficult to obtain. Therefore, rolling in the last stage is preferably performed at 1080° C. or higher. When the rolling temperature in the last stage of the rough rolling 12 is higher than 1150° C., that is, when the rolling temperature exceeds 1150° C. during the rough rolling 12, the austenite grain after the finish rolling 13 sometimes becomes large and ferrite transformation in a dual-phase region occurring in later cooling is not sufficiently promoted, so that the specific microstructure is sometimes difficult to obtain. Therefore, the rolling in the last stage is preferably performed at 1150° C. or lower.

When a cumulative reduction ratio in the last stage of the rough rolling 12 and the previous first stage thereof is more than 65%, an austenite grain after the finish rolling 13 sometimes becomes excessively small, and transformation from austenite to ferrite is excessively promoted, so that specific bainite is sometimes difficult to obtain. Therefore, the cumulative reduction ratio is preferably 65% or less. When the cumulative reduction ratio is less than 40%, the austenite grain after the finish rolling 13 sometimes becomes large and ferrite transformation in the dual-phase region occurring in later cooling is not sufficiently promoted, so that the specific microstructure is sometimes difficult to obtain. Therefore, the cumulative reduction ratio is preferably 40% or more.

The finish rolling 13 is an important process to generate the grains having an intragranular misorientation of 5° to 14°. The grains having an intragranular misorientation of 5° to 14° are obtained by transformation of austenite, which includes strain due to being subjected to processing, into bainite. Therefore, it is important to perform the finish rolling 13 under a condition which make the strain remain in austenite after the finish rolling 13.

In the finish rolling 13, the rolling in the last three stages is performed with a cumulative strain of more than 0.600 and 0.700 or less. When the cumulative strain in the rolling in the last three stages is 0.6 or less, an austenite grain after the finish rolling 13 becomes large and ferrite transformation in the dual-phase region occuring in later cooling is not sufficiently promoted, failing to make the proportion of the grains having an intragranular misorientation of 5° to 14° to 5% to 50%. When the cumulative strain in the rolling in the last three stages is more than 0.7, the strain remains excessively in austenite after the finish rolling 13, failing to make the proportion of the grains having an intragranular misorientation of 5° to 14° to 5% to 50%, with the result that the workability is deteriorated.

The cumulative strain ($\epsilon_{eff}$) in the last three stages of the finish rolling 13 referred to here can be obtained by the following Expression (1).

$$\epsilon_{eff}=\Sigma\epsilon_i(t,\ T) \tag{1}$$

where, $$\mathbf{68}_i(t,\ T)=\epsilon_{i0}/exp\{(t/\tau_R)2/3),$$

$$\tau_R=\tau_0\cdot exp(Q/RT),$$

$$\tau_0\cdot=8.46\times10^{-6},$$

$$Q=183200J, \text{ and}$$

$$R=8.314\ J/K\cdot mol, \text{ and}$$

$\epsilon_{i0}$ represents logarithmic strain in reduction, t represents an accumulated time until start of cooling at the stage, and T represents a rolling temperature at the stage.

In the finish rolling 13, the rolling in the last stage is performed in a temperature range of the Ar3 point or higher and the Ar3 point +30° C. or lower, and at a reduction ratio of 6% or more to 15% or less. When the temperature of the rolling in the last stage (finish rolling temperature) is higher than the Ar3 point +30° C. or the reduction ratio is less than 6%, a residual amount of the strain in austenite after the finish rolling 13 becomes insufficient, so that the specific microstructure cannot be obtained. When the finish rolling temperature is lower than the Ar3 point or the reduction ratio is more than 15%, the strain remains excessively in austenite after the finish rolling 13, so that the workability is deteriorated.

An Ar1 transformation point temperature (temperature at which austenite completes transformation to ferrite or to ferrite and cementite in cooling), an Ar3 transformation point temperature (temperature at which austenite starts transformation to ferrite in cooling), an Ac1 transformation point temperature (temperature at which austenite starts to be generated in heating), and an Ac3 transformation point temperature (temperature at which transformation to austenite is completed in heating) are simply expressed in a relation with steel components by the following calculation expressions.

Ar1 transformation point temperature (° C.)=730−102×(% C)+29×(% Si)−40×(% Mn)−18×(% Ni)−28×(% Cu)−20×(% Cr)−18×(% Mo)

Ar3 transformation point temperature (° C.)=900−326×(% C)+40×(% Si)−40×(% Mn)−36×(% Ni)−21×(% Cu)−25×(% Cr)−30×(% Mo)

Ac1 transformation point temperature (° C.) =751−16×(% C)+11×(% Si)−28×(% Mn)−5.5×(% Cu)−16×(% Ni)+13×(% Cr)+3.4×(% Mo)

Ac3 transformation point temperature (° C.)=910−203√(% C)+45×(% Si)−30×(% Mn)−20×(% Cu)−15(% Ni)+11×(% Cr)+32×(% Mo)+104×(% V)+400×(% Ti)+200(%Al)

Here, (% C), (% Si), (% Mn), (% Ni), (% Cu), (% Cr), (% Mo), (% V), (% Ti), (%Al) denote contents (mass %) of C, Si, Mn, Ni, Cu, Cr, Mo, V, Ti, Al, respectively. The elements not contained are calculated as 0%.

After the finish rolling 13, the cooling (first cooling) 14 is performed on the run out table (ROT) down to a temperature of 650° C. or higher and 750° C. or lower. When the last temperature of the cooling 14 is lower than 650° C., ferrite transformation in the dual-phase region becomes insufficient, failing to obtain sufficient ductility. When the last temperature of the cooling 14 is higher than 750° C., ferrite transformation is excessively promoted, failing to make the proportion of the grains having an intragranular misorientation of 5° to 14° to 5% to 50%. An average cooling rate in the cooling 14 is 10 ° C./sec or more. This is for stably making the proportion of the grains having an intragranular misorientation of 5° to 14° to 5% to 50%.

On completion of the cooling 14, the air cooling 15 for 3 seconds or more to 10 seconds or less is performed. When the time period of the air cooling 15 is less than 3 seconds, ferrite transformation in the dual-phase region becomes insufficient, failing to obtain sufficient ductility. When the time period of the air cooling 15 is more than 10 seconds, ferrite transformation in the dual-phase region is excessively promoted, failing to obtain the specific microstructure.

On the completion of the air cooling 15, cooling (second cooling) 16 down to a temperature of 350° C. or higher and 450° C. or lower is performed at an average cooling rate of 30° C./sec or more. When the average cooling rate is less than 30° C./sec, for example, a large amount of pearlite is generated, failing to obtain the specific microstructure.

Thereafter, the winding 16 at a temperature of preferably 350° C. or higher and 450° C. or lower is performed. When the temperature of the winding 16 is higher than 450° C., ferrite is generated and sufficient bainite cannot be obtained, failing to obtain the specific microstructure. When the temperature of the winding 16 is lower than 350° C., martensite is generated and sufficient bainite cannot be obtained, failing to obtain the specific microstructure.

Even if the hot-rolled steel sheet according to the present embodiment is subjected to a surface treatment, effects to improve the strength, ductility, and stretch-flangeability can be obtained. For example, electroplating, hot dipping, deposition plating, organic coating, film laminating, organic salts treatment, inorganic salts treatment, non-chromate treatment, and others may be performed.

Note that the above-described embodiments merely illustrates concrete examples of implementing the present invention, and the technical scope of the present invention is not to be construed in a restrictive manner by these embodiments. That is, the present invention may be implemented in various forms without departing from the technical spirit or main features thereof.

EXAMPLES

Next, examples of the present invention will be described. Conditions in the examples are examples of conditions employed to verify feasibility and effects of the present invention, and the present invention is not limited to the examples of conditions. The present invention can employ various conditions without departing from the spirit of the present invention to the extent to achieve the objects of the present invention.

In this experiment, samples of hot-rolled steel sheets having microstructures and grains listed in Table 2 were manufactured by using a plurality of steels (steel symbols A to Q) having chemical compositions listed in Table 1, and their mechanical characteristics were investigated.

The proportion of the grains having an intragranular misorientation of 5° to 14° was measured by the aforementioned method using the EBSD analyzer. The area ratios of retained austenite, ferrite, bainite, pearlite, and martensite were measured by the above method using the optical microscope.

Then, a tensile test and the saddle-type stretch-flange test of each hot-rolled steel sheet were carried out. The tensile test was carried out by using a No. 5 test piece described in Japan Industrial Standard (JIS) Z 2201 fabricated from each hot-rolled steel sheet and in accordance with a method described in Japan Industrial Standard (JIS) Z 2241. The saddle-type stretch-flange test was carried out by the aforementioned method. The "index" in Table 2 is a value of the index (H×TS) of the stretch-flangeability.

As listed in Table 2, only in the samples within the range of the present invention, excellent ductility and stretch-flangeability were obtained while the high strength was obtained. Note that in Sample No. 15, a slab fracture occurred. Besides, in Samples No. 11 and No. 17, forming was impossible in the saddle-type stretch-flange test.

Each hot-rolled steel sheet was manufactured as below under conditions listed in Table 3. After smelting and continuous casting in a steel converter were carried out, heating was carried out at a heating temperature listed in Table 3 to perform hot-rolling including rough rolling and finish rolling. A heating temperature, and a cumulative strain in the last three stages and a finish temperature of the finish rolling are listed in Table 3. After the finish rolling, cooling was performed on the run out table (ROT) at a cooling rate listed in Table 3 down to a temperature T1 listed in Table 3. Then, once the temperature reached the temperature T1, air cooling was started. A time period of the air cooing is listed in Table 3. After the air cooling, cooling was carried out down to a temperature T2 listed in Table 3 at an average cooling rate listed in Table 3, and winding was carried out to thereby fabricate a hot-rolled coil. The "lapse time" in Table 3 is time from completion of the finish rolling to start of the first cooling. Underlines in Table 3 each indicate that a numerical value thereof is out of a preferable range.

TABLE 1

| STEEL SYMBOL | C | Si | Mn | P | S | Al | N | Cr | Mo | Ni | Cu | B | Ti |
|---|---|---|---|---|---|---|---|---|---|---|---|---|---|
| A | 0.10 | 1.40 | 1.40 | 0.018 | 0.005 | 0.040 | 0.0018 | | | | | | |
| B | 0.08 | 1.50 | 1.50 | 0.030 | 0.002 | 0.030 | 0.0021 | | | | | | |
| C | 0.15 | 1.50 | 1.00 | 0.010 | 0.003 | 0.030 | 0.0020 | | 0.02 | | | | |
| D | 0.20 | 1.60 | 1.60 | 0.030 | 0.004 | 0.020 | 0.0031 | | | | | | 0.005 |
| E | 0.10 | 2.05 | 2.00 | 0.020 | 0.003 | 0.040 | 0.0028 | | | | | | |
| F | 0.21 | 2.05 | 2.20 | 0.015 | 0.004 | 0.030 | 0.0025 | | | | | | |
| G | 0.20 | 3.00 | 1.70 | 0.009 | 0.004 | 0.050 | 0.0032 | | | | | 0.0004 | |
| H | 0.13 | 1.10 | 1.47 | 0.030 | 0.003 | 0.950 | 0.0038 | | | | | | |
| I | 0.12 | 1.35 | 1.46 | 0.012 | 0.003 | 0.030 | 0.0056 | | | 0.01 | 0.02 | | |
| J | 0.09 | 1.42 | 1.41 | 0.006 | 0.002 | 0.030 | 0.0020 | 0.15 | | | | | |
| K | 0.24 | 1.27 | 0.87 | 0.013 | 0.003 | 0.030 | 0.0026 | | | | | | |
| L | 0.03 | 2.45 | 2.07 | 0.015 | 0.003 | 0.040 | 0.0031 | | | | | | |
| M | 0.14 | 3.31 | 0.88 | 0.013 | 0.004 | 0.030 | 0.0028 | | | | | | |
| N | 0.13 | 0.27 | 2.14 | 0.012 | 0.003 | 0.020 | 0.0018 | | | | | | |
| O | 0.07 | 1.16 | 2.61 | 0.010 | 0.005 | 0.030 | 0.0020 | | | | | | |
| P | 0.08 | 3.11 | 0.38 | 0.011 | 0.004 | 0.030 | 0.0042 | | | | | | |
| Q | 0.14 | 1.53 | 0.96 | 0.015 | 0.005 | 0.050 | 0.0106 | | | | | | |

TABLE 1-continued

| STEEL SYMBOL | Nb | V | W | Sn | Zr | As | Co | Ca | Mg | REM |
|---|---|---|---|---|---|---|---|---|---|---|
| A | | | | 0.0002 | | | | | | |
| B | | | 0.003 | | | | | 0.001 | | |
| C | | | | | 0.0003 | | | | 0.0003 | |
| D | | | | | | | | | | 0.0005 |
| E | 0.007 | | | | | | 0.0002 | | | |
| F | | | | | | | | | | |
| G | | | | | | 0.0003 | | | | |
| H | | 0.004 | | | | | | | | |
| I | | | | | | | | | | |
| J | | | | | | | | | | |
| K | | | | | | | | | | |
| L | | | | | | | | | | |
| M | | | | | | | | | | |
| N | | | | | | | | | | |
| O | | | | | | | | | | |
| P | | | | | | | | | | |
| Q | | | | | | | | | | |

| Sample No. | Steel Symbol | Prportion of Grains Having Intragranular Misorientation of 5° to 14° (%) | Area Ratio of Ferrite (%) | Area Ratio of Banite (%) | Area Ratio of Retained Austentite (%) | Area Ratio of Martensite (%) | Area Ratio of Pearlite (%) |
|---|---|---|---|---|---|---|---|
| 1 | A | 17 | 75 | 20 | 5 | 0 | 0 |
| 2 | B | 12 | 83 | 13 | 3 | 1 | 0 |
| 3 | C | 14 | 80 | 12 | 8 | 0 | 0 |
| 4 | D | 19 | 70 | 12 | 18 | 0 | 0 |
| 5 | E | 23 | 60 | 27 | 11 | 2 | 0 |
| 6 | F | 33 | 40 | 45 | 12 | 3 | 0 |
| 7 | G | 29 | 45 | 40 | 10 | 5 | 0 |
| 8 | H | 15 | 79 | 11 | 10 | 0 | 0 |
| 9 | I | 15 | 77 | 13 | 9 | 1 | 0 |
| 10 | J | 14 | 81 | 12 | 7 | 0 | 0 |
| 11 | K | 4 | 34 | 0 | 0 | 0 | 66 |
| 12 | L | 9 | 90 | 9 | 0 | 1 | 0 |
| 13 | M | 11 | 87 | 10 | 3 | 0 | 0 |
| 14 | N | 24 | 55 | 40 | 0 | 5 | 0 |
| 15 | O | | | SLAB FRACTURE | | | |
| 16 | P | 4 | 82 | 0 | 0 | 0 | 18 |
| 17 | Q | 17 | 75 | 16 | 9 | 0 | 0 |
| 18 | A | 11 | 10 | 88 | 0 | 2 | 0 |
| 19 | A | 13 | 90 | 0 | 0 | 0 | 10 |
| 20 | C | 20 | 85 | 0 | 0 | 0 | 15 |
| 21 | C | 14 | 55 | 0 | 0 | 0 | 45 |
| 22 | C | 18 | 10 | 88 | 0 | 2 | 0 |
| 23 | E | 11 | 15 | 81 | 0 | 4 | 0 |
| 24 | E | 10 | 85 | 5 | 0 | 0 | 10 |
| 25 | F | 11 | 40 | 45 | 0 | 0 | 15 |
| 26 | F | 13 | 40 | 45 | 0 | 15 | 0 |
| 27 | F | 12 | 40 | 45 | 0 | 2 | 13 |
| 28 | F | 4 | 40 | 48 | 11 | 4 | 0 |
| 29 | F | 75 | 45 | 40 | 12 | 3 | 0 |

| Sample No. | Yield Strength (MPa) | Tensile Strength TS (MPa) | Index (mm · MPa) | NOTE |
|---|---|---|---|---|
| 1 | 453 | 619 | 21071 | Inventive Example |
| 2 | 480 | 615 | 19770 | Inventive Example |
| 3 | 447 | 644 | 20124 | Inventive Example |
| 4 | 557 | 804 | 20096 | Inventive Example |
| 5 | 582 | 826 | 21000 | Inventive Example |
| 6 | 768 | 1121 | 19709 | Inventive Example |
| 7 | 732 | 1036 | 20631 | Inventive Example |
| 8 | 451 | 658 | 20619 | Inventive Example |
| 9 | 463 | 662 | 20572 | Inventive Example |
| 10 | 449 | 638 | 20812 | Inventive Example |
| 11 | 653 | 706 | Forming Impossible | Comparative Example |

-continued

| | | | | |
|---|---|---|---|---|
| 12 | 432 | 543 | 14875 | Comparative Example |
| 13 | 536 | 642 | 15968 | Comparative Example |
| 14 | 616 | 672 | 16074 | Comparative Example |
| 15 | | SLAB FRACTURE | | Comparative Example |
| 16 | 503 | 568 | 10074 | Comparative Example |
| 17 | 487 | 633 | Forming Impossible | Comparative Example |
| 18 | 564 | 684 | 12174 | Comparative Example |
| 19 | 522 | 609 | 11788 | Comparative Example |
| 20 | 533 | 628 | 13395 | Comparative Example |
| 21 | 589 | 658 | 9623 | Comparative Example |
| 22 | 616 | 671 | 12302 | Comparative Example |
| 23 | 795 | 857 | 9216 | Comparative Example |
| 24 | 722 | 794 | 7437 | Comparative Example |
| 25 | 984 | 1088 | 6258 | Comparative Example |
| 26 | 780 | 1245 | 9323 | Comparative Example |
| 27 | 954 | 1060 | 6065 | Comparative Example |
| 28 | 758 | 966 | 11060 | Comparative Example |
| 29 | 773 | 1185 | 19452 | Comparative Example |

TABLE 3

| | | | | FINISH ROLLING | | |
|---|---|---|---|---|---|---|
| SAMPLE No. | STEEL SYMBOL | Ar3 (° C.) | HEATING TEMPERATURE (° C.) | CUMULATIVE STRAIN IN THE LAST THREE STAGES | FINISH TEMPERATURE (° C.) | LAPSE TIME (s) |
| 1 | A | 867 | 1230 | 0.641 | 880 | 1.5 |
| 2 | B | 874 | 1230 | 0.641 | 890 | 1.5 |
| 3 | C | 871 | 1230 | 0.641 | 890 | 1.5 |
| 4 | D | 835 | 1230 | 0.641 | 865 | 1.5 |
| 5 | E | 869 | 1230 | 0.641 | 890 | 1.5 |
| 6 | F | 826 | 1230 | 0.641 | 850 | 1.5 |
| 7 | G | 887 | 1230 | 0.640 | 900 | 1.5 |
| 8 | H | 843 | 1230 | 0.641 | 860 | 1.5 |
| 9 | I | 856 | 1230 | 0.641 | 875 | 1.5 |
| 10 | J | 867 | 1230 | 0.641 | 885 | 1.5 |
| 11 | K | 839 | 1230 | 0.641 | 860 | 1.2 |
| 12 | L | 905 | 1230 | 0.640 | 920 | 1.2 |
| 13 | M | 952 | 1230 | 0.639 | 960 | 1.2 |
| 14 | N | 783 | 1230 | 0.642 | 800 | 1.2 |
| 15 | O | 919 | | SLAB FRACTURE | | |
| 16 | P | 983 | 1230 | 0.638 | 985 | 1.2 |
| 17 | Q | 877 | 1230 | 0.641 | 880 | 1.2 |
| 18 | A | 867 | 1230 | 0.689 | 980 | 1.1 |
| 19 | A | 867 | 1230 | 0.693 | 800 | 1.1 |
| 20 | C | 871 | 1250 | 0.692 | 880 | 1.1 |
| 21 | C | 871 | 1250 | 0.692 | 880 | 1.1 |
| 22 | C | 871 | 1250 | 0.692 | 880 | 1.1 |
| 23 | E | 869 | 1250 | 0.692 | 880 | 1.1 |
| 24 | E | 869 | 1250 | 0.692 | 880 | 1.1 |
| 25 | F | 826 | 1200 | 0.693 | 840 | 1.1 |
| 26 | F | 826 | 1200 | 0.693 | 840 | 1.1 |
| 27 | F | 826 | 1200 | 0.693 | 840 | 1.1 |
| 28 | F | 826 | 1200 | 0.980 | 830 | 1.1 |
| 29 | F | 826 | 1200 | 0.587 | 850 | 1.1 |

| | FIRST COOLING | | TIME PERIOD | SECOND COOLING | |
|---|---|---|---|---|---|
| SAMPLE No. | COOLING RATE (° C./s) | LAST TEMPERATURE T1 (° C.) | OF AIR COOLING (s) | COOLING RATE (° C./s) | LAST TEMPERATURE T2 (° C.) |
| 1 | 15 | 670 | 4 | 35 | 400 |
| 2 | 20 | 680 | 5 | 40 | 410 |
| 3 | 40 | 700 | 6 | 45 | 430 |
| 4 | 45 | 720 | 5 | 50 | 380 |
| 5 | 20 | 730 | 6 | 35 | 390 |
| 6 | 25 | 700 | 7 | 60 | 370 |
| 7 | 45 | 660 | 5 | 40 | 420 |
| 8 | 40 | 680 | 4 | 45 | 400 |
| 9 | 35 | 690 | 3 | 60 | 440 |
| 10 | 40 | 700 | 8 | 35 | 400 |
| 11 | 50 | 710 | 7 | 40 | 390 |
| 12 | 30 | 720 | 5 | 40 | 410 |
| 13 | 30 | 730 | 9 | 35 | 430 |

TABLE 3-continued

| | | | | | |
|---|---|---|---|---|---|
| 14 | 35 | 740 | 7 | 40 | 430 |
| 15 | | | SLAB FRACTURE | | |
| 16 | 25 | 680 | 4 | 55 | 410 |
| 17 | 30 | 670 | 6 | 40 | 430 |
| 18 | 15 | 670 | 4 | 35 | 400 |
| 19 | 15 | 670 | 4 | 35 | 400 |
| 20 | 5 | 700 | 6 | 45 | 430 |
| 21 | 40 | 800 | 6 | 45 | 430 |
| 22 | 40 | 600 | 6 | 45 | 430 |
| 23 | 20 | 730 | 1 | 35 | 390 |
| 24 | 20 | 730 | 15 | 35 | 390 |
| 25 | 25 | 700 | 7 | 15 | 370 |
| 26 | 25 | 700 | 7 | 60 | 300 |
| 27 | 25 | 700 | 7 | 60 | 500 |
| 28 | 25 | 700 | 7 | 60 | 370 |
| 29 | 25 | 700 | 7 | 60 | 370 |

INDUSTRIAL APPLICABILITY

The present invention may be used in an industry related to a hot-rolled steel sheet used for an underbody part of an automobile, for example.

The invention claimed is:

1. A hot-rolled steel sheet, comprising:

a chemical composition represented by, in mass%:

C: 0.06% to 0.22%;
Si: 1.0% to 3.2%;
Mn: 0.8% to 2.2%;
P: 0.05% or less;
S: 0.005% or less;
Al: 0.01% to 1.00%;
N: 0.006% or less;
Cr: 0.00% to 1.00%;
Mo: 0.000% to 1.000%;
Ni: 0.000% to 2.000%;
Cu: 0.000% to 2.000%;
B: 0.0000% to 0.0050%;
Ti: 0.000% to 0.005%;
Nb: 0.000% to 0.200%;
V: 0.000% to 1.000%;
W: 0.000% to 1.000%;
Sn: 0.0000% to 0.2000%;
Zr: 0.0000% to 0.2000%;
As: 0.0000% to 0.5000%;
Co: 0.0000% to 1.0000%;
Ca: 0.0000% to 0.0100%;
Mg: 0.0000% to 0.0100%;
REM: 0.0000% to 0.1000%; and balance: Fe and impurities; and a microstructure represented by, in vol %:

retained austenite: 9% to 30%;
ferrite: 60% to 85%;
bainite: 10% to 31%;
pearlite: 5% or less; and
martensite: 10% or less, wherein a proportion of grains having an intragranular misorientation of 5° to 14° in all grains is 5% to 50% by area ratio, the grain being defined as an area which is surrounded by a boundary having a grain boundary misorientation of 15° or more and has a circle-equivalent diameter of 0.3 μm or more.

2. The hot-rolled steel sheet according to claim 1, wherein, in the chemical composition, Cr: 0.05% to 1.00%, in mass %, is satisfied.

3. The hot-rolled steel sheet according to claim 2, wherein, the chemical composition comprises, Mo: 0.001% to 1.000%,
Ni: 0.001% to 2.000%,
Cu: 0.001% to 2.000%,
B: 0.0001% to 0.0050%,
Ti: 0.001% to 0.005%,
Nb: 0.001% to 0.200%,
V: 0.001% to 1.000%,
W: 0.001% to 1.000%,
Sn: 0.0001% to 0.2000%,
Zr: 0.0001% to 0.2000%,
As: 0.0001% to 0.5000%,
Co: 0.0001% to 1.0000%,
Ca: 0.0001% to 0.0100%,
Mg: 0.0001% to 0.0100%, or
REM: 0.0001% to 0.1000%, or
any combination thereof.

4. The hot-rolled steel sheet according to claim 1, wherein, the chemical composition comprises, Mo: 0.001% to 1.000%,
Ni: 0.001% to 2.000%,
Cu: 0.001% to 2.000%,
B: 0.0001% to 0.0050%,
Ti: 0.001% to 0.005%,
Nb: 0.001% to 0.200%,
V: 0.001% to 1.000%,
W: 0.001% to 1.000%,
Sn: 0.0001% to 0.2000%,
Zr: 0.0001% to 0.2000%,
As: 0.0001% to 0.5000%,
Co: 0.0001% to 1.0000%,
Ca: 0.0001% to 0.0100%,
Mg: 0.0001% to 0.0100%, or
REM: 0.0001% to 0.1000%, or
any combination thereof.

* * * * *